US009962981B2

(12) United States Patent
Zhou et al.

(10) Patent No.: US 9,962,981 B2
(45) Date of Patent: May 8, 2018

(54) PRINTABLE RECORDING MEDIA

(71) Applicant: Hewlett-Packard Development Company, L.P., Houston, TX (US)

(72) Inventors: Xiaoqi Zhou, San Diego, CA (US); Xulong Fu, San Diego, CA (US); Haowen Yu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/544,195

(22) PCT Filed: Jan. 28, 2015

(86) PCT No.: PCT/US2015/013284
§ 371 (c)(1),
(2) Date: Jul. 17, 2017

(87) PCT Pub. No.: WO2016/122487
PCT Pub. Date: Aug. 4, 2016

(65) Prior Publication Data

US 2018/0009252 A1 Jan. 11, 2018

(51) Int. Cl.
*B41M 5/50* (2006.01)
*B41J 2/01* (2006.01)
(Continued)

(52) U.S. Cl.
CPC ..... *B41M 5/504* (2013.01); *B41J 2/01* (2013.01); *B41M 5/502* (2013.01); *B41M 5/506* (2013.01); *B41M 5/508* (2013.01); *B41M 5/5218* (2013.01); *B41M 5/5245* (2013.01); *B05D 3/002* (2013.01); *B05D 3/007* (2013.01); *B41M 2205/36* (2013.01)

(58) Field of Classification Search
CPC ..... B41M 5/502; B41M 5/504; B41M 5/506; B41M 5/508; B41M 5/5218; B41M 5/5245; B05D 3/002; B05D 3/007
See application file for complete search history.

(56) References Cited

U.S. PATENT DOCUMENTS 5,660,928 A 8/1997 Stokes et al.
5,798,179 A 8/1998 Kronzer
(Continued)

FOREIGN PATENT DOCUMENTS

WO WO-2010/098770 9/2010

OTHER PUBLICATIONS

International Search Report and Written Opinion for International Application No. PCT/US2015/013284 dated Oct. 27, 2015, 12 pages.

*Primary Examiner* — Betelhem Shewareged
(74) *Attorney, Agent, or Firm* — HP Inc. Patent Department

(57) ABSTRACT

A printable recording media that contains a substrate, an ink receiving layer having a (WT)IR factor of less than 0.9 on the image side of the substrate, and a curvature control layer having a the (WT)CC of less than 0.6, on the backside side of the substrate. The printable recording media has an R value, (WT)IR/(WT)CC that is ranging from 1.6 to 3.0. The ink receiving layer and the curvature control layer include, at least, a single or multiple types of polymeric binders and, at least, a single or multiple types of inorganic pigment particles.

15 Claims, 2 Drawing Sheets

(51) Int. Cl.
*B41M 5/52* (2006.01)
*B05D 3/00* (2006.01)

(56) References Cited

U.S. PATENT DOCUMENTS

| | | | |
|---|---|---|---|
| 5,858,555 | A | 1/1999 | Kuroyama et al. |
| 6,028,028 | A | 2/2000 | Nitta |
| 6,040,060 | A | 3/2000 | Missel et al. |
| 6,458,413 | B1 | 10/2002 | Hirabayashi et al. |
| 6,902,794 | B2 | 6/2005 | Hirabayashi et al. |
| 7,056,969 | B2 | 6/2006 | Cuch et al. |
| 7,569,255 | B2 | 8/2009 | Dannhauser et al. |
| 7,829,160 | B2 | 11/2010 | Schultz et al. |
| 8,053,044 | B2 | 11/2011 | Zhou et al. |
| 8,105,665 | B2 | 1/2012 | Kaimoto |
| 8,158,222 | B2 | 4/2012 | Kaimoto et al. |
| 8,227,054 | B2 | 7/2012 | Ono et al. |
| 8,268,414 | B2 | 9/2012 | Tran et al. |
| 8,293,343 | B2 | 10/2012 | Nakano |
| 8,377,522 | B2 | 2/2013 | Desrousseaux et al. |
| 8,425,728 | B2 | 4/2013 | Zhou et al. |
| 8,733,918 | B2 | 5/2014 | Sasada et al. |
| 8,771,811 | B2 | 7/2014 | Takahashi et al. |
| 2001/0009174 | A1 | 7/2001 | Dinkel et al. |
| 2002/0060727 | A1* | 5/2002 | Nishita ..... B41M 5/0017 347/100 |
| 2004/0009301 | A1 | 1/2004 | Xing et al. |
| 2004/0058098 | A1 | 3/2004 | Kondo et al. |
| 2004/0197498 | A1 | 10/2004 | Bi et al. |
| 2005/0007434 | A1 | 1/2005 | Anagnostopoulos et al. |
| 2006/0045998 | A1 | 3/2006 | Kitamura et al. |
| 2006/0147659 | A1 | 7/2006 | Foley |
| 2006/0233975 | A1 | 10/2006 | Tran et al. |
| 2007/0202280 | A1 | 8/2007 | Khoultchaev et al. |
| 2007/0207278 | A1 | 9/2007 | Mukherjee et al. |
| 2009/0110910 | A1 | 4/2009 | Kaimoto et al. |
| 2009/0130312 | A1 | 5/2009 | Ono et al. |
| 2011/0242192 | A1 | 10/2011 | Sasada et al. |
| 2011/0244147 | A1 | 10/2011 | Wang et al. |
| 2012/0225223 | A1 | 9/2012 | Takahashi et al. |
| 2013/0243977 | A1 | 9/2013 | Zhou et al. |
| 2014/0139601 | A1 | 5/2014 | Pal et al. |

* cited by examiner

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including low printer noise, capability of high-speed recording and multi-color recording. Inkjet web printing is a technology that is specifically well adapted for commercial and industrial printing. Example of such printing technology is the "HP Page Wide Array printing" where more than hundreds of thousand tiny nozzles on a stationary print-head that spans the width of a page, delivering multi-colors ink onto a moving sheet of paper under a single pass to achieve the super-fast printing speed.

With these printing technologies, it is apparent that the image quality of printed images is strongly dependent on the construction of the recording media used. Consequently, improved recording media, often specifically designed, have been developed.

BRIEF DESCRIPTION OF THE DRAWINGS

The drawings illustrate various embodiments of the present recording media and are part of the specification.

DETAILED DESCRIPTION

Figure 1:
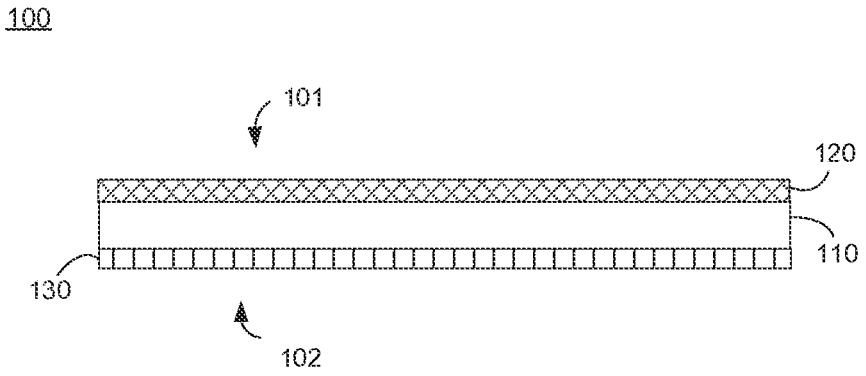
FIGS. 1 and 2 are cross-sectional views of the printable recording media according to embodiments of the present disclosure.

The present disclosure refers to a printable recording media comprising a substrate, an ink receiving layer (IR) having a $(WT)_{IR}$ factor of less than 0.9 on the image side of the substrate, and a curvature control (CC) layer having a the $(WT)_{CC}$ of less than 0.6, on the backside side of the substrate, wherein the R value, $(WT)_{IR}/(WT)_{CC}$, is ranging from 1.6 to 3.0; and wherein the ink receiving layer and the curvature control layer include, at least, a single or multiple types of polymeric binders and, at least, a single or multiple types of inorganic pigment particles. The present disclosure refers also to a method for making the printable recording media.

Before particular embodiments of the present disclosure are disclosed and described, it is to be understood that the present disclosure is not limited to the particular process and materials disclosed herein. It is also to be understood that the terminology used herein is used for describing particular embodiments only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some examples, the printable recording media is an inkjet printable medium. The substrate can thus be specifically designed to receive any inkjet printable ink, such as, for example, organic solvent-based inkjet inks or aqueous-based inkjet inks Examples of inkjet inks that may be deposited, established, or otherwise printed on the printable substrate, include pigment-based inkjet inks, dye-based inkjet inks, pigmented latex-based inkjet inks and UV curable inkjet inks. The printable recording media, described herein, provides printed images and articles that demonstrate excellent image quality (good bleed and coalescence performance) while enabling high-speed and very high-speed printing. By high-speed printing, it is meant herein that the printer can generate up to 30 sheet of arch D size (610 mm×915 mm) per minute with full colored images for examples.

The printable recording media provides printed images that have, in the same time, an excellent gloss and a high absorptivity. The resulting printed article and image have, therefore, outstanding print quality. In some examples, the images printed on the recording media, such as described herein, are able to impart excellent image quality: provides vivid color, such as higher gamut and have a high degree of gloss, and high color density. High print density and color gamut volume are realized with substantially no visual color-to-color bleed and with good coalescence characteristics.

The printable recording media provides printed images that do not show visible print mottle. Print mottle or mottling is a defect that often presents as uneven random color patterns in a large area of an image. It is believed that uneven absorption of ink vehicle in the coating layer causes this defect, a result of uneven coat weight/thickness on base paper, and/or variation of pore structure in the coating layer. For coated paper, the underneath base paper is usually rougher than the final sheets. During coating process, the thickness of the coating layer may vary with any bumps and valleys on the base paper surface. Even with precise coating methods, there is often uneven coating thickness across the web. Since the absorption of liquid in coating layer is different than absorption in the base paper, variation of the coat weight is a major cause of print mottle. In addition, coated paper usually goes through a calender or super calender step after the coating process in order to produce a smother surface and/or higher gloss products. Under pressure and/or high temperature, the pores in the coating layer will deform. Due to uneven base paper and variation of coating thickness, calendering can easily cause differences in pore structure, i.e., patterns of pore size distribution and pore shape. Such differences might, in many cases, cause variation of ink penetration rate in the coating layer, and eventually exacerbate a print mottle defect. In addition, the printable recording media has, in the same time, excellent surface smoothness and a high absorptivity. The resulting printed article and image have, therefore, outstanding print durability and print quality.

The printable recording media, described herein, is considered to have improved flatness and decreased cockling problems, issues that are often founded in high speed printing applications. Indeed, some paper media can be subjected to problems relating to one or more of cockle, curl, wrinkle, crease, and/or mis-registration, which can detrimentally impact productivity, product quality and cost. For example, inkjet printing has a much higher moisture level than offset and gravure printing due to the colored pigments of the inkjet ink being applied to the paper media using, for example, a water based liquid vehicle, which might cause non-uniform hygro-expansion. Cockle refers to a small scale expansion in paper fiber width when wetted with water that might come from water-based inkjet inks.

In some examples, the printable recording media of the present disclosure does not present any "curvature issue". By "curvature", it is meant herein the upward or downward curve of edges of a planar sheet. The printable recording media is considered as substantially free of curvature at all application condition in order to ensure good printer running-ability under high speed printing. Indeed, under such printing condition, media curvature can be a prominent factor impacting printer running-ability. In some examples, if a media has too much positive curvature (i.e., toward the image receiving layer), the inkjet printhead might tend to scrape the paper and cause a print jam or print defect. In some other examples, if a media has too much negative curvature (i.e., toward the back side), it can cause sheet feeding problems in the paper handling tray. In some examples, printable recording media of the present disclosure is a printing media which is substantially free of curvature at all application condition, where "substantially free of curvature" refers to the amount of upward or downward curvature of the print media is within +/−5 mm, at all application condition.

Not bonded to any theory, it is believed that the cause of curvature on printing media is due to unbalanced stress distribution on each side of the media. The environment, especially the moisture from media storage and application will make the stress even more unbalanced if the absorption rate and volume of each side is different. There are many factors to influence the stress distribution and one of main factor are coat weight related binder effect in coating.

The printable media has an optimized absorption rate. The resulting printed article and image have, therefore, outstanding print quality. By "optimized absorption rate", it is meant that the water, solvent and/or vehicle of the ink can be absorbed by the media at a fast rate so that the ink composition does not have a chance to interact and cause bleed and/or coalescence issues and also not caused any ink transfer to any rollers inside the paper path of the printer. On another hand, the recording media is also constructed in order to avoid any excessive absorption of the ink colorant (pigments) so that ink optical density and color gamut are decreased. The faster the printing speed and the higher the amount of ink used, the higher is the demand on faster absorption from the media. A good diagnostic plot with maximum ink density, such as secondary colors, would be prone to coalescence and a pattern of lines of the primary and secondary colors passing through area fills of primary and secondary colors would be prone to bleed. If no bleed or coalescence is present at the desired printing speed, the absorption rate would be sufficient. Bristow wheel measurements can be used for a quantitative measure of absorption on media wherein a fixed amount of a fluid is applied through a slit to a strip of media that moves at varying speeds. In some examples, the printing substrate has an ink absorption rate that is not less than 10 $ml/m^2 \times sec^{1/2}$, as measured by Bristow wheel ink absorption method. (The Bristow wheel is an apparatus also called the Paprican Dynamic Sorption Tester, model LBA92, manufactured by Op Test Equipment Inc.).

In some examples, the printing substrate has a surface smoothness that is less than 150 Sheffield smoothness unites. In some other examples, the printing substrate has a surface smoothness that is less than 100 Sheffield smoothness unite. In yet some other examples, the printing substrate has a surface smoothness that ranges between from about 30 to about 90 Sheffield smoothness unite. The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit).

In some examples, the media according to the present disclosure exhibit TAAPI brightness of at least 80%. In some other examples, the printable recording media has a TAAPI brightness that is at least 85% (on a scale of 1 to 100). The Tappi brightness is measured using TAPPI Standard T452, "Brightness of pulp, paper, and paperboard (directional reflectance at 457 nm)" by means of Technidyne Brightmeter. Measurements are made at 457 nm blue light at a 45° angle and reported.

In some examples, the printable recording media used herein is a coated glossy medium that can print at speeds needed for commercial and other printers such as, for example, a Hewlett Packard (HP) Inkjet Web Press (Hewlett Packard Inc., Palo Alto, Calif., USA). The properties of the print media in accordance with the principles described herein are comparable to coated media for offset printing. The printable recording media can have a 75° gloss (sheet gloss) that is greater than 30%; or that is greater than 45%. Such gloss is referred as the "Sheet Gloss" and measures how much light is reflected with a 75 degree (°) geometry on the unprinted recording media. 75° Sheet Gloss testing is carried out by Gloss measurement of the unprinted area of the sheet with a BYK-Gardner Micro-Gloss® 75° Meter (BYK-Gardner USA, Columbia, Md., USA).

Figure 2:
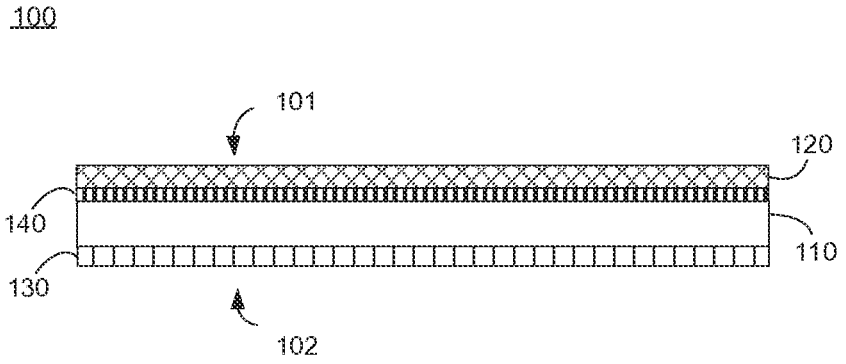
Figure 3:
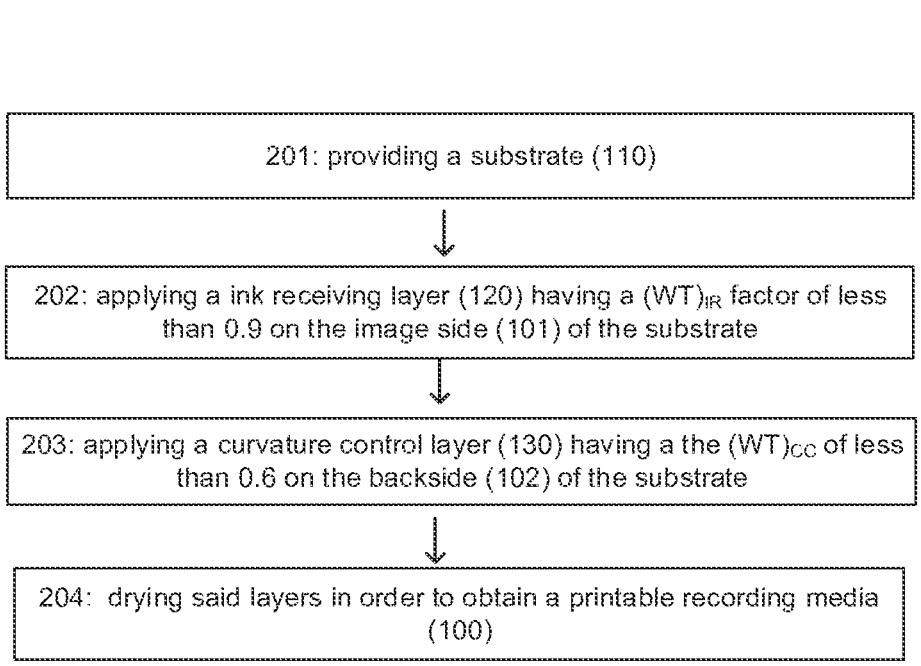
FIG. 3 is a flow chart of a method for making a printable recording media in accordance with an example of the present disclosure.

FIG. 1 and FIG. 2 illustrate the printable recording media (100) as described herein. In some examples, as illustrated in FIG. 1, the printable media (100) has an image or printed side (101) and a backside or opposing side (102). The image side (101) of the media is the side that includes material layers that will receive, support and protect an image. The backside (102) of the media, or opposing side, is not designed for receiving printing image and will merely act as a support. The printable recording media (100) encompasses a bottom supporting substrate or substrate (110), an ink receiving layer (120) and a curvature control layer (130). The ink receiving layer (120) is applied on one side of the substrate (110), on the image side (101), and the printing inks will be applied on top of this layer. The layer is referred therefore as image receiving layer, or $_{IR}$ layer. The printable recording media (100) contains a curvature control layer (130), or CC layer, on the other side of the substrate (backside (102)) i.e. the side that will not receive any image. The printable recording media (100) has thus a sandwich structure. In some other examples, as illustrated in FIG. 2, the printable media (100) encompasses a resin-rich coating layer (140). The resin-rich coating layer that is built between substrate (110) and the ink receiving layer (120) on the image side (101) of the printable media. FIG. 3 is a flow chart of a method for making the printable recording media in accordance with an example of the present disclosure.

According to the present disclosure, it has been found that the amount of polymeric binders, present in the ink receiving layer and in the curvature control layer coating compositions and, also, the coating thickness are factors that impact the curvature level of the printable recording media. Such parameters are factors that can be illustrated with a WT value. The printable recording media have thus a specific WT value, wherein the WT value is a factor multiplication of dry weight percent of binder and coating thickness. The ink receiving layer has a WT value, $(WT)_{IR}$ factor, that is less than 0.9, in some examples, and, that is less than 0.8 in some other examples. The curvature control layer has a WT value, $(WT)_{CC}$ factor, that is less than 0.6, in some examples and that is less than 0.5 in some other examples.

The printable recording media according to the present disclosure has also a specific R value wherein the R value is the ratio of WT values of the ink receiving layer and of the curvature control layer: $R=(WT)_{IR}/(WT)_{CC}$. In some examples, the R value of the printable recording media is between 1.6 and 3.0. Indeed, it has been shown that printable recording media with an R value that is lower than 1.6, will result in negative curvature, especially at higher humidity condition. Also, it has been shown that printable recording media with R value that is higher than 3.0, will result in positive curvature.

In some examples, the polymeric binders that are present in the ink receiving layer (120) and in the curvature control layer (130) are water soluble polymeric binders, since they shows better curvature (than water dispersible binders) in the same WT and R value range.

In some aspect, the invention disclosure relates to an article comprising a cellulose paper substrate having, on its image receiving side, a resin-rich layer and an ink receiving layer that comprises an electrical charged substance, a single or multiple types of polymeric binders and at least a single or multiple types of inorganic pigment particles; and a curvature control layer that comprises a single or multiple types of polymeric binders and at least a single or multiple types of inorganic pigment particles.

Ink Receiving Layer

The printable recording media comprises a substrate (110) and an ink receiving layer (120) disposed on one side of the substrate. The ink receiving layer (120) is applied on the image side (101) of the substrate. The ink receiving layer include, at least, a single or multiple types of polymeric binders and, at least, a single or multiple types of inorganic pigment particles. In some other examples, the composition used to form the ink receiving layer (120) comprises an electrical charged substance; a single or multiple types of polymeric binders and at least a single or multiple types of inorganic pigment particles (filler material). The ink receiving layer (120) can have a construction which comprises multi-layer structures which are based on the same or different coating compositions. Each composition, used to build the ink receiving layer, comprises an electrical charged substance; a single or multiple types of polymeric binders and at least a single or multiple types of inorganic pigment particles (filler material). The ink receiving layer could then be considered as a composite structure. The word "composite" refers herein to a material made from at least two constituent materials, or layers, that have different physical and/or chemical properties from one another, and wherein these constituent materials/layers remain separate at a molecular level and distinct within the structure of the composite.

The ink receiving layer (120) that is disposed on the image side (101) of the supporting substrate (110) and can form a layer having a coat-weight in the range of about 0.5 to about 30 gram per square meter ($g/m^2$ or gsm), or in the range of about 1 to about 20 gsm, or in the range of about 1 to about 15 gsm per side. In some examples, the printable recording media has an ink receiving layer (120) that is applied to only one side of the supporting substrate (110), the image side of the substrate (101), and that has a coat-weight in the range of about 2 to about 10 gsm. In some other examples, the thickness of the ink receiving layer (120) is ranging from about 0.01 micrometers to about 50 micrometers (μm) out of the top surface of the cellulose base.

The ink receiving layer (120) is applied directly on the outmost surface of the substrate (110). The ink receiving layer will received the ink that will form the printed image. In one examples, one of the function of the ink receiving layer is thus to receive the ink and form the printed image with the desired attributes. The ink receiving layer (120) could be called "blocking layer" since one of its function is to be a blocking layer for ink colorants, also known as pigments. This layer has thus multiple functions. Indeed, the ink receiving layer can be able, when receiving ink drops, to crash or to separate ink pigment from ink solvent, and, secondly, it can be able to chemical bonding the ink pigment and to prevent the further penetration pigments of into the cellulose base but let ink solvent vehicle flow into the base instantly. Not bonded to any theory, it is believed that migration of ink pigments into cellulose base will decrease color gamut and therefore reduce printing quality.

In addition, without being linked by any theory, it is believed that the function of the ink receiving layer (120) is to control the "dot gain". The "dot gain" is the difference between the dot size on the source file and the corresponding dot size on the printed result. It refers to diameter of halftone dots increases during printing process. The got gain makes material looking darker than intended and certain degree of dot gain is desirable in order to hide any missing nozzle defect during one pass high speed inkjet printing. However, excessive dot gain need to be avoid since it will results ink bleed defects and damage edge quality of print-out. For example, a pixel may indicate a 50% dot, but after printing, it is measured to be 70%, showing a "dot gain" of 20%. Murray-Davies equation, can computes the dot gain from density measurements according to the Equation 1 below.

$$\text{Dot Gain} = \frac{1-10^{(D_0-D_N)}}{1-10^{(D_0-D_{100})}} \times 100 - N \qquad \text{Equation 1}$$

In this equation, $D_0$ is the measured density of a 0% dot (i.e. unprinted substrate), $D_{100}$ is the density of a 100% dot, and $D_N$ is the density of the sample N % dot (very often, N=50). In high speed printing, a certain degree of dot gain is desirable in order to hide any missing nozzle defect during one pass of high speed inkjet printing. However, excessive dot gain need to be avoided since it will results in ink bleed defects and damage edge quality of print-out.

Curvature Control Layer

The printable recording media comprises a substrate (110), an ink receiving layer (120) disposed on the image side of the media and a curvature control layer (130) disposed on the backside of the media (i.e. on the non-image side or opposite side). It is believed that the function of the curvature control layer (130) is to balance stress difference with the front ink receiving layer. The curvature control layer (130) can have a construction which comprises multi-layer structures which are based on the same or different coating composition. The curvature control layer (130) could then be considered as a composite structure. Each composition used to build the curvature control layer comprises a single or multiple types of polymeric binders and, at least, a single or multiple types of inorganic pigment particles.

The curvature control layer (130) can be disposed on the backside the substrate (110) and can form a layer having a coat-weight in the range of about 0.5 to about 30 gram per square meter ($g/m^2$ or gsm), or in the range of about 1 to about 20 gsm, or in the range of about 1 to about 15 gsm.

The curvature control layer (130) can comprise a single or multiple types of polymeric hydrophilic binders that is hydrophilic, meaning thus that it will be able absorb the water and/or any moisture, such as polyvinyl alcohol for examples. In some examples, the curvature control layer (130) contains a single or multiple types of polymeric hydrophilic binders which can absorb more than 10% moisture by weight of itself. In some other examples, the curvature control layer (130) contains a single or multiple types of polymeric hydrophilic binders which can absorb more than 30% moisture by weight of itself.

The curvature control layer (130) comprises, at least, a single or multiple types of inorganic pigment particles. In some examples, the curvature control layer contains from about 40 wt % to about 95 wt % of inorganic pigment particles by total weight of the curvature control layer. The curvature control layer (130) comprises water soluble binders. In some examples, at least 50 wt % by total weight of the binders are water soluble binders; in some other examples, at least 80 wt % by total weight of the binders are water soluble binders; in yet some other examples, 100 wt % by total weight of the binders are water soluble binders.

The ink receiving layer (120) and the curvature control layer (130) contains a single or multiple types of pigment particles or pigments fillers. The pigment particles present in the ink receiving layer and in the curvature control layer can be either different or similar. For example, the pigment filler may comprise any organic or inorganic pigment with a micro-porous structure, or which can form a micro-porous structure during solidification on a surface of the cellulose-based paper during coating manufacture. Representative examples of pigment filler materials (e.g., that facilitate the image receiving layer) include calcium carbonate, zeolite, silica, talc, alumina, aluminum trihydrate (ATH), calcium silicate, kaolin, calcined clay, and combinations or mixtures of any of these.

In some examples, the surface area of the inorganic pigment particles is in the range of about 20 to about 800 square meter per gram or in the range of about 25 to about 350 square meter per gram. The surface area can be measured, for example, by adsorption using BET isotherm. In some examples, the inorganic pigment particles are pre-dispersed in a dispersed slurry form before being mixed with the composition for coating on the substrate. An alumina powder can be dispersed, for example, with high share rotor-stator type dispersion system such as an Ystral system.

In some examples, the ink receiving layer and the curvature control layer contain from about 40 wt % to about 95 wt % of inorganic pigment particles by total weight of the each layer. In some other examples, the ink receiving layer and the curvature control layer contains from about 65 wt % to about 85 wt % of inorganic pigment particles by total weight of each layer.

In some examples, the ink receiving layer contains a single or multiple types of pigment particles or pigments fillers that are consider as nano-size pigment particles. By "nano-sized" pigment particles, it is meant herein pigments, in the form of particle, that have an average particles size that in in the nanometer sizes ($10^{-9}$ meters). Said particle are considered as substantially spherical or irregular. In some examples, the inorganic pigment particles, that are present in the ink receiving layer, have an average particle size in the range of about 1 to about 150 nanometer (nm); in some other examples, the inorganic pigment particles, that are present in the ink receiving layer, have an average particle size in the range of about 2 to about 100 nanometer (nm), or, in yet some other examples, the nano-size inorganic pigment particles of the ink receiving layer have an average particle size in the range of about 5 to about 50 nanometer (nm).

In some examples, the nano-size inorganic pigment particles, that are present in the ink receiving layer, are metal oxides or complex metal oxides particles. As used herein, the term "metal oxide particles" encompasses metal oxide particles or insoluble metal salt particles. Metal oxide particles are particles of metal oxide that have high refractive index (i.e. more than 1.65) and that have particle size in the nano-range such that they are substantially transparent to the naked eye. The visible wavelength is ranging from about 400 to about 700 nm.

Examples of nano-size inorganic pigment particles include, but are not limited to, titanium dioxide, hydrated alumina, calcium carbonate, barium sulfate, silica, high brightness alumina silicates, boehmite, pseudo-boehmite, zinc oxide, kaolin clays, and/or the$_{ir}$ combination. The inorganic pigment can include clay or a clay mixture. The inorganic pigment particles can include a calcium carbonate or a calcium carbonate mixture. The calcium carbonate may be one or more of ground calcium carbonate (GCC), precipitated calcium carbonate (PCC), modified GCC, and modified PCC. The inorganic particles that can also be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the inorganic particles are aluminum oxide ($Al_2O_3$) or silicon dioxide ($SiO_2$). Example of such inorganic particles is for examples, Disperal® HP-14, Disperal® HP-16 and Disperal® HP-18 available from Sasol Co.

In some examples, the inorganic pigment particles are calcium carbonate, aluminum oxide ($Al_2O_3$) or silicon dioxide ($SiO_2$). In some other examples, the inorganic pigment particles is calcium carbonate.

The nano-size inorganic pigment particles could also be a "colloidal solution" or "colloidal sol". Said colloidal sol is a composition that nano-size particles with metal oxide structure such as aluminum oxide, silicon oxide, zirconium oxide, titanium oxide, calcium oxide, magnesium oxide, barium oxide, zinc oxide, boron oxide, and mixture of two or more metal oxide. In some examples, such as the colloidal sol is a mixture of about 10 to 20 wt % of aluminum oxide and about 80 to 90 wt % of silicon oxide. In some examples, such as the colloidal sol is a mixture of about 14 wt % of aluminum oxide and about 86 wt % of silicon oxide. The nano-size inorganic pigment particles can be, in the aqueous solvent, either cationically or anionically charged and stabilized by various opposite charged groups such as chloride, sodium ammonium and acetate ions. Examples of colloidal sol are commercial available under the tradename Nalco 8676, Nalco® 1056, Nalco 1057, as supplier by NALCO Chemical Company; or under the name Ludox®/Syton® such as Ludox® HS40 and HS30, TM/SM/AM/AS/LS/SK/CL-X and Ludox® TMA from Grace Inc.; or under the name Ultra-Sol 201A-280/140/60 from Eminess Technologies Inc.

The colloidal sol can also be prepared by using particles agglomerates which have the chemical structure as descripted above but which have starting particles size in the range of about 5 to 10 micrometer (10-6 meters). Such colloidal sol can be obtained by breaking agglomerates using chemical separation and mechanical shear force energy. Monovalent acids such as nitric, hydrochloric, formic or acetic with a PKa value of 4.0 to 5.0 can be used. Agglomerates are commercial available, for example, from Sasol, Germany under the tradename of Disperal® or from Dequenne Chimie, Belgium under the Dequadis®HP.

In some examples, the curvature control layer contains inorganic pigment particles that have a size range that is at least 100 times bigger than the size of the inorganic pigment particles that are present in the ink receiving layer. In some examples, the inorganic pigment particles that are present in the curvature control layer, can be a clay or a clay mixture. The inorganic pigment particles that are present in the curvature control layer, can be a calcium carbonate or a calcium carbonate mixture. The calcium carbonate may be one or more of ground calcium carbonate (GCC), precipitated calcium carbonate (PCC), modified GCC, and modified PCC. In some other examples, the inorganic pigment particles that are present in the curvature control layer are calcium carbonate pigment particles.

Such inorganic pigment particles can be, for example, ground calcium carbonate such as Hydrocarb® 60 available from Omya, Inc.; precipitated calcium carbonate such as Opacarb®A40 or Opacarb®3000 available from Specialty Minerals Inc. (SMI); clay such as Miragloss® available from Engelhard Corporation; synthetic clay such as hydrous sodium lithium magnesium silicate, such as, for example, Laponite® available from Southern Clay Products Inc., and titanium dioxide ($TiO_2$) available from, for example, Sigma-Aldrich Co. Examples of inorganic pigment particles that can be present in the curvature control layer include, but are not limited to, particles, either existing in a dispersed slurry or in a solid powder, of polystyrene and its copolymers, polymethyacrylates and the$_{ir}$ copolymers, polyacrylates and the$_{ir}$ copolymers, polyolefins and the$_{ir}$ copolymers, such as polyethylene and polypropylene, a combination of two or more of the polymers. The inorganic pigment particles that can be present in the curvature control layer may be chosen from silica gel (e.g., Silojet®703C available from Grace Co.), modified (e.g., surface modified, chemically modified, etc.) calcium carbonate (e.g., Omyajet®B6606, C3301, and 5010, all of which are available from Omya, Inc.), precipitated calcium carbonate (e.g., Jetcoat 30 available from Specialty Minerals, Inc.), and combinations thereof.

The ink receiving layer (120) and the curvature control layer (130) contains a single or multiple types of polymeric binder. The polymeric binder, present in the ink receiving layer and in the curvature control layer, can be either different or similar. The composition of both the ink receiving layer (120) and curvature control layer (130) comprise a binder or a combination of binders. In some examples, the binders are water soluble binders but water dispersible binders can also be added. The binders used in ink receiving layer (120) can be chemically the same or different from the binders used in curvature control layer (130). Without behind bounded by any theory, it is believed that the binding material (i.e. binders) provides binding adhesion among pigment particles and also provides adhesion between pigment particles and the cellulose fibers of the raw base.

The polymeric binder can be either water a soluble, a synthetic or a natural substances or an aqueous dispersible substance like polymeric latex. In some other examples, the polymeric binder is polymeric latex. The polymeric binder can be a water soluble polymer or water dispersible polymeric latex. The binder may be selected from the group consisting of water-soluble binders and water dispersible polymers that exhibit high binding power for base paper stock and pigments, either alone or as a combination. In some examples, the polymeric binder components have a glass transition temperature (Tg) ranging from −10° C. to +50° C. The way of measuring the glass transition temperature (Tg) parameter is described in, for example, Polymer Handbook, 3rd Edition, authored by J. Brandrup, edited by E. H. Immergut, Wiley-Interscience, 1989.

In some examples, the ink receiving layer (120) and the curvature control layer (130) contains water soluble polymeric binder. The water soluble polymeric binder, present in the ink receiving layer and in the curvature control layer, can be either different or similar. Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Non-limitative examples of suitable binders include styrene butadiene copolymer, polyacrylates, polyvinylacetates, polyacrylic acids, polyesters, polyvinyl alcohol, polystyrene, polymethacrylates, polyacrylic esters, polymethacrylic esters, polyurethanes, copolymers thereof, and combinations thereof. In some examples, the binder is a polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the binder component is a latex containing particles of a vinyl acetate-based polymer, an acrylic polymer, a styrene polymer, an SBR-based polymer, a polyester-based polymer, a vinyl chloride-based polymer, or the like. In yet some other examples, the binder is a polymer or a copolymer selected from the group consisting of acrylic polymers, vinyl-acrylic copolymers and acrylic-polyurethane copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; acetoacetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval®235, Mowiol®56-88, Mowiol®40-88 (products of Kuraray and Clariant).

The binder may have an average molecular weight (Mw) of about 5,000 to about 500,000. In some examples, the binder has an average molecular weight (Mw) ranging from about 100,000 to about 300,000. In some other examples, the binder has an average molecular weight of about 250,000. The average particle diameter of the latex binder can be from about 10 nm to about 10 μm; in some other examples, from about 100 nm to about 5 μm; and, in yet other examples, from about 500 nm to about 0.5 μm. The particle size distribution of the binder is not particularly limited, and either binder having a broad particle size distribution or binder having a mono-dispersed particle size distribution may be used. The binder may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

In some examples, the binder is selected from natural macromolecule materials such as starches, chemical or biological modified starches and gelatins. The binder could be a starch additive. The starch additive may be of any type, including but not limited to oxidized, ethylated, cationic and pearl starch. In some examples, the starch is used in an aqueous solution. Suitable starches that can be used herein are modified starches such as starch acetates, starch esters, starch ethers, starch phosphates, starch xanthates, anionic starches, cationic starches and the like which can be derived by reacting the starch with a suitable chemical or enzymatic reagent. In some examples, the starch additives can be native starch, or modified starches (enzymatically modified starch or chemically modified starch). In some other examples, the starches are cationic starches and chemically modified starches. Useful starches may be prepared by known techniques or obtained from commercial sources. Examples of suitable starches include Penford Gum-280 (commercially available from Penford Products), SLS-280 (commercially available from St. Lawrence Starch), the cationic starch CatoSize 270 (from National Starch) and the hydroxypropyl No. 02382 (from Poly Sciences). In some examples, a suitable size press/surface starch additive is 2-hydroxyethyl starch ether, which is commercially available under the tradename Penford®Gum 270 (available from Penford Products).

In some examples, due to strong tendency of re-agglomeration of the particles due to change of ionic strength, the binder is a non-ionic binder. Examples of such binders are commercially available, for example, from Dow Chemical Inc. under the tradename Aquaset® and Rhoplex® emulsions, or are polyvinyl alcohol commercially available from Kuraray American Inc. under the tradename Poval®, Mowiol® and Mowiflex®.

The ink receiving layer (120) contains an electrical charged substance. "Electrical charged" refers to chemical substance with some atoms gaining or losing one or more electrons or protons, together with a complex ion consists of an aggregate of atoms with opposite charge. The electrical charged substance is a charged ion or associated complex ion that can de-coupled in an aqueous environment. In some examples, the electrical charged substance is an electrolyte, having a low molecular species or a high molecular species. The electrical charged substance can be present, in the ink receiving layer, in an amount representing from about 0.05 gram to about 5 gram per square meter ($m^2$) of the printing base substrate. In some other examples, the electrical charged substance can be present, in the ink receiving layer, in an amount representing from about 0.2 to about 1.5 gram per square meter ($m^2$) of the printing base substrate.

In some examples, the electrical charged substance is a water soluble, divalent or multi-valent metal salt. The term "water soluble" is meant to be understood broadly as a species that is readily dissolved in water. Thus, water soluble salts may refer to a salt that has a solubility greater than 15 g/100 g $H_2O$ at 1 Atm. pressure and at 200° C.

The electrical charged substance can be a water soluble metallic salt which means that the ink receiving layer comprises a water soluble metallic salt. The water soluble metallic salt can be an organic salt or an inorganic salt. The electrical charged substance can be an inorganic salt; in some examples, the electrical charged substance is a water-soluble and multi-valent charged salts. Multi-valent charged salts include cations, such as Group I metals, Group II metals, Group III metals, or transition metals, such as sodium, calcium, copper, nickel, magnesium, zinc, barium, iron, aluminum and chromium ions. The associated complex ion can be chloride, iodide, bromide, nitrate, sulfate, sulfite, phosphate, chlorate, acetate ions. The electrical charged substance can be an organic salt; in some examples, the electrical charged substance is a water-soluble organic salt; in yet some other examples, the electrical charged substance is a water-soluble organic acid salt. Organic salt refers to associated complex ion that is an organic specifies, where cations may or may not the same as inorganic salt like metallic cations. Organic metallic salt are ionic compounds composed of cations and anions with a formula such as $(C_nH_{2n+1}COO^-M^+)*(H_2O)_m$ where $M^+$ is cation species including Group I metals, Group II metals, Group III metals and transition metals such as, for example, sodium, potassium, calcium, copper, nickel, zinc, magnesium, barium, iron, aluminum and chromium ions. Anion species can include any negatively charged carbon species with a value of n from 1 to 35. The hydrates ($H_2O$) are water molecules attached to salt molecules with a value of m from 0 to 20. Examples of water soluble organic acid salts include metallic acetate, metallic propionate, metallic formate, metallic oxalate, and the like. The organic salt may include a water dispersible organic acid salt. Examples of water dispersible organic acid salts include a metallic citrate, metallic oleate, metallic oxalate, and the like.

In some examples, the electrical charged substance is a water soluble, divalent or multi-valent metal salt. Specific examples of the divalent or multi-valent metal salt used in the coating include, but are not limited to, calcium chloride, calcium acetate, calcium nitrate, calcium pantothenate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Divalent or multi-valent metal salt might also include $CaCl_2$, $MgCl_2$, $MgSO_4$, $Ca(NO_3)_2$, and $Mg(NO_3)_2$, including hydrated versions of these salts. In some examples, the water soluble divalent or multi-valent salt can be selected from the group consisting of calcium acetate, calcium acetate hydrate, calcium acetate monohydrate, magnesium acetate, magnesium acetate tetrahydrate, calcium propionate, calcium propionate hydrate, calcium gluconate monohydrate, calcium formate and combinations thereof.

Examples of high molecular charged substance include, but not limited, polyaluminium chloride, polyaluminium chloro sulphate, polyaluminium silicosulphate, polydiallyldimethylammonium chloride, quaternary polyamines, poly (styrenesulfonic acid) and dicyandiamide resins. In some examples, the electrical charged substance is calcium chloride and/or calcium acetate. In some other examples, the metal salt is calcium chloride.

In addition to the above-described components, the ink receiving layer and the curvature control layer formulations might also contain other components or additives, as necessary, to carry out the required mixing, coating, manufacturing, and other process steps, as well as to satisfy other requirements of the finished product, depending on its intended use. The additives include, but are not limited to, one or more of rheology modifiers, thickening agents, cross-linking agents, surfactants, defoamers, optical brighteners, dyes, pH controlling agents or wetting agents, and dispersing agents, for example. The total amount of additives, in the composition for forming the layer, can be from about 0.1 wt % to about 10 wt % or from about 0.2 wt % to about 5 wt %, by total dry weight of the ink receiving layer.

Substrate

As illustrated in FIG. 1, the printable media (100) contains a substrate (110) that supports the ink receiving layer (120) and the curvature control layer (130). The substrate acts as a bottom substrate layer or supporting base. The substrate can be considered as having an image side and a backside (or opposing side). The image side is the side where the image receiving layer will be applied. The backside of the substrate is the side where the curvature control layer will be applied. Such substrate, which can also be called base print media substrate or base substrate or supporting substrate, contains a material that serves as a base upon which the ink receiving layer and the curvature control layer are applied. The substrate provides integrity for the resultant printable media.

The basis weight of the print media substrate is dependent on the nature of the application of the printable recording media where lighter weights are employed for magazines, books and tri-folds brochures and heavier weights are employed for post cards and packaging applications, for example. The substrate can have a basis weight of about 60 grams per square meter ($g/m^2$ or gsm) to about 400 gsm, or about 100 gsm to about 250 gsm.

In some examples, the substrate is a paper base substrate. The media substrate can also be a photo-base paper, an uncoated plain paper or a plain paper having a porous coating, such as a calendared paper, an un-calendared paper, a cast-coated paper, a clay coated paper, or a commercial offset paper. The photobase may be a paper that is coated by co-extrusion with a high- or low-density polyethylene, polypropylene, or polyester on both surfaces of the paper.

The substrate may include any materials which can support a coating composition, for example, natural materials (such as a base including cellulose fibers) or synthetic material, (such as a base including synthetic polymeric fibers) or non-fabric materials (such as a polymeric film) or a mixture of them. The substrate material has good affinity and good compatibility for the ink that is applied to the material. Examples of substrates include, but are not limited to, natural cellulosic material, synthetic cellulosic material (such as, for example, cellulose diacetate, cellulose triacetate, cellulose propionate, cellulose butyrate, cellulose acetate butyrate and nitrocellulose), material including one or more polymers such as, for example, polyolefins, polyesters, polyamides, ethylene copolymers, polycarbonates, polyurethanes, polyalkylene oxides, polyester amides, polyethylene terephthalate, polyethylene, polystyrene, polypropylene, polycarbonate, polyvinyl acetal, polyalkyloxazolines, polyphenyl oxazolines, polyethylene-imines, polyvinyl pyrrolidones, and combinations of two or more of the above. The media substrate can be a paper base including paper, cardboard, paperboard, paper laminated with plastics, and paper coated with resin. The substrate may include polymeric binders. Such polymeric binder may be included, for example, when non-cellulose fibers are used.

In some examples, the substrate is a cellulose based substrate, meaning thus that it contains cellulose. The cellulose base could be made from pulp stock containing a fiber ratio (hardwood fibers to softwood fibers) of 70:30. The hardwood fibers have an average length ranging from about 0.5 mm to about 1.5 mm. These relatively short fibers improve the formation and smoothness of the base. Suitable hardwood fibers can include pulp fibers derived from deciduous trees (angiosperms), such as birch, aspen, oak, beech, maple, and eucalyptus. The hardwood fibers may be bleached or unbleached hardwood fibers. Rather than virginal hardwood fibers, other fibers with the same length, up to 20% of total hardwood fiber content, can be used as the hardwood fiber. The other fibers may be recycled fibers, non-deinkable fibers, unbleached fibers, synthetic fibers, mechanical fibers, or combinations thereof. The softwood fibers have an average length ranging from about 2 mm to about 7 mm. These relatively long fibers improve the mechanical strength of the base. Suitable softwood fibers can include pulp fibers derived from coniferous trees (gymnosperms), such as varieties of fir, spruce, and pine (e.g., loblolly pine, slash pine, Colorado spruce, balsam fir, and Douglas fir). The fibers may be prepared via any known pulping process, such as, for example, chemical pulping processes. Two suitable chemical pulping methods include the kraft process and the sulphite process.

The fibers of the substrate material may be produced from chemical pulp, mechanical pulp, thermal mechanical pulp, chemical mechanical pulp or chemical thermo-mechanical pulp. Examples of wood pulps include, but are not limited to, Kraft pulps and sulfite pulps, each of which may or may not be bleached. The substrate may also include non-cellulose fibers. The pulp used to make the cellulose base may also contain up to 10 wt % (with respect to total solids) of additives. Suitable additives may be selected from a group consisting of a dry strength additive, wet strength additive, a filler, a retention aid, a dye, an optical brightening agent (i.e., optical brightener), a surfactant, a sizing agent, a biocide, a defoamer, or a combination thereof.

Resin-rich Layer

The printable recording media may further comprise a resin-rich layer (140) or backing coating layer or barrier layer. The resin-rich layer might be deposited over the base substrate (110), on the image side (101) of the media, below the ink receiving layer (120). The resin-rich layer is present thus between the substrate and the ink receiving layer. When present, the resin-rich layer is applied to the base substrate at a coat weight ranging from about 0.1 gsm to about 1.5 gsm.

The resin-rich layer can be considered as a barrier layer that reduce the penetration of ink vehicle into fiber base (into the substrate). Excessively penetration of ink vehicle may cause fiber base winkles. However, this layer cannot form a continuous film on the top of the fiber base since the film-forming will substantially block the ink vehicle migration which in turn will cause ink dry time issue during high speed printing. To balance the migration speed and volume of the ink vehicle, the ratio of composition of resin-rich layer by weight to that of the fiber base is ranged from 0.001 to 0.008.

The barrier layer includes one or more types of hydrophobic polymer resin binder. The term "resin-rich" refers to compositions in which larger proportions of polymer resin components are included. For example, the resin-rich barrier layer can include from about 60 wt % to about 80 wt % of resins by total weight of resin-rich layer. The hydrophobic polymer resin binder refers to polymers which have binder powder among the fillers and binding power to adhere the fillers to the substrate. In some examples, the resin used in the resin-rich layer is a water soluble or water dispersible hydrophobic resin or combination of those resins. Examples of the resins are, but not limited to, polyacrylic, styrene copolymer with dienes like styrene butadiene copolymer, styrene copolymer with other monomers like styrene-acrylamides copolymer, styrene-methacrylates copolymer, glycidyl methacrylate copolymer, glycidyl acrylate copolymer, glycidyl vinyl ether copolymer, glycidyl vinyl phthalate copolymer, poly (vinyl ethers), poly(mervinyl esters), poly (N-vinylpyrrolidone) and chemical modified starch like hydroxypropylated starch. The resin-rich layer can optionally include small amount of inorganic fillers, such as clay, kaolin, calcium carbonate, talc, titanium dioxide, silica, calcium silicate, ATH and Zeolite. The weight percentage of the filler can be, for examples, less than 30 wt %, or, in some other examples, less than 15 wt % or less than 5 wt %.

Method of Making a Printable Recording Media

In some examples, according to the principles described herein, a method of making the printable recording media as described herein is provided. Such method encompasses: providing a substrate (110); applying a ink receiving layer (120) having a $(WT)_{IR}$ factor of less than 0.9 on the image side of the substrate; applying a curvature control (130) layer having a $(WT)_{CC}$ of less than 0.6 on the backside of the substrate; drying said layers in order to obtain a printable recording media. Said printable recording media has an R value, $(WT)_{IR}/(WT)_{CC}$, that is ranging from 1.6 to 3.0. Said printable recording media has an ink receiving layer and a curvature control layer that include, at least, a single or multiple types of polymeric binders and, at least, a single or multiple types of inorganic pigment particles. In some examples, a resin-rich layer (140) can be applied between the substrate (110) and the ink receiving layer (120). In some other examples, the printable recording media can be calendered in order to obtain the desired the gloss and smoothness.

FIG. 4 is a flow chart of a method (200) for making a printable recording media according to the present disclosure. In this method, a substrate is provided (201); then an ink receiving layer (IR) having a $(WT)_{IR}$ factor of less than 0.9 is applied on the image side of the substrate (202). A curvature control (CC) layer, having a $(WT)_{CC}$ of less than 0.6, is then applied on the backside of the substrate (203). Both layers are then dried (204) in order to obtain a printable recording media wherein the R value, $(WT)_{IR}/(WT)_{CC}$, is ranging from 1.6 to 3.0 and wherein the ink receiving layer and the curvature control layer include, at least, a single or multiple types of polymeric binders and, at least, a single or multiple types of inorganic pigment particles.

The ink receiving layer (120) and the curvature control layer (130), as exemplified above, can be applied to the front and back sides, respectively, of fiber base substrate using any suitable technique and apparatus. In some examples, the ink receiving layer (120) and the curvature control layer (130) are applied simultaneously on both opposing sides of the base substrate. The ink receiving layer (120) and the curvature control layer (130) can be applied to the substrate (110) by using one of a variety of suitable coating methods, for example blade coating, $a_{ir}$ knife coating, metering rod coating, size press, curtain coating, or another suitable technique. For example, the blocking layer may be applied using a conventional off-line coater, or use an online surface sizing unit, such as a puddle-size press, film-size press, or the like. The puddle-size press may be configured as having horizontal, vertical, and inclined rollers. In another example, the film-size press may include a metering system, such as gate-roll metering, blade metering, Meyer rod metering, or slot metering. For some examples, a film-size press with short-dwell blade metering may be used as application head to apply coating solution. The non-contact coating method example, the spray coating, is also suitable for this application.

The above described resin rich layer (140) can be applied with a metering sizing press in-line on the paper machine. Alternatively, the resin rich layer may be applied using an off-line coater such as rod, roll, blade, curtain, cascade, gravure, $a_{ir}$ knife coaters, or the like. The fiber base can be then calendered either in-line on the paper machine or off-line with hard nip, softnip or super-calender to form a fiber base for further ink receiving layer and curvature control layer processing. In some examples, after the coating step, the media might go through a drying process to remove water and other volatile components present in the layers and substrate. The drying pass may comprise several different drying zones, including, but not limited to, infrared dryers, hot surface rolls, and hot $a_{ir}$ floatation boxes.

In some other examples, after the coating and drying steps, the coated web may receive a glossy or satin surface with a calendering or super calendering step. When a calendering step is desired, the coated product passes an on-line or off-line calender machine, which could be a softnip calender or a super-calender. The rolls, in the calender machine, may or may not be heated, and certain pressure can be applied to calendering rolls. In addition, the coated product may go through embosser or other mechanical roller devices to modify surface characteristics such as texture, smoothness, gloss, etc In some examples, the substrate (110) can be made of fiber base. The fiber base can be made by, firstly, by forming a pulp slurry that is distributed in a head box onto a moving, continuous wire, where water drains from the slurry by gravity, or aided by vacuum. The wet paper sheet can go through presses, driers and calenders, and the resulting paper can be rolled into large rolls. When the base substrate is base paper stock, the composition for forming the ink receiving layer can be applied on the base paper stock by an in-line surface size press process such as a puddle-sized press or a film-sized press, for example. In addition to in-line surface sizing processing, off-line coating technologies can also be used to apply the composition for forming the ink receiving layer to the print media substrate. Examples of suitable coating techniques include, but are not limited to, slot die coaters, roller coaters, fountain curtain coaters, blade coaters, rod coaters, air knife coaters, gravure applications, and air brush applications, for example.

Method for Producing Printed Images

A method for producing printed images, or printing method, includes providing a printable recording media such as defined herein; applying an ink composition on the ink receiving layer of the print media, to form a printed image; and drying the printed image in order to provide, for example, a printed image with enhanced quality. The printable recording media contains a substrate, an ink receiving layer having a $(WT)_{IR}$ factor of less than 0.9 on the image side of the substrate, and a curvature control layer having a the $(WT)_{CC}$ of less than 0.6, on the backside of the substrate, wherein the R value, $(WT)_{IR}/(WT)_{CC}$, is ranging from 1.6 to 3.0; and wherein the ink receiving layer and the curvature control layer include, at least, a single or multiple types of polymeric binders and, at least, a single or multiple types of inorganic pigment particles.

In some examples, the printing method for producing images is an inkjet printing method. By inkjet printing method, it is meant herein a method wherein a stream of droplets of ink is jetted onto the recording substrate or media to form the desired printed image. The ink composition may be established on the recording media via any suitable inkjet printing technique. Examples of inkjet method include methods such as a charge control method that uses electrostatic attraction to eject ink, a drop-on-demand method which uses vibration pressure of a Piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is applied onto the recording media using inkjet nozzles. In some other examples, the ink composition is applied onto the recording method using thermal inkjet printheads.

In some examples, the printing method as described herein prints on one-pass only. The paper passes under each nozzle and printhead only one time as opposed to scanning type printers where the printheads move over the same area of paper multiple times and only a fraction of total ink is used during each pass. The one-pass printing puts 100% of the ink from each nozzle/printhead down all at once and is therefore more demanding on the ability of the paper to handle all of the ink in a very short amount of time. As mentioned above, a print media in accordance with the principles described herein may be employed to print images on one or more surfaces of the print media. In some examples, the method of printing an image includes depositing ink that contains particulate colorants. A temperature of the print media during the printing process is dependent on one or more of the nature of the printer, for example.

The printed image may be dried after printing. The drying stage may be conducted, by way of illustration and not limitation, by hot air, electrical heater or light irradiation (e.g., $_{IR}$ lamps), or a combination of such drying methods. In order to achieve best performances, it is advisable to dry the ink at a maximum temperature allowable by the print media that enables good image quality without deformation. Examples of a temperature during drying are, for examples, from about 60° C. to about 205° C., or from about 120° C. to about 180° C. The printing method may further include a drying process in which the solvent (such as water), that can be present in the ink composition, is removed by drying. As a further step, the printable recording media can be submitted to a hot $a_{ir}$ drying systems. The printing method can also encompass the use of a fixing agent that will retain with the pigment, present in the ink composition that has been jetted onto the media.

EXAMPLES

Ingredients:

TABLE 1

| Ingredient name | Nature of the ingredient | supplier |
|---|---|---|
| Hydrocarb ® H60 | inorganic pigment particulates (GCC) | Omya Inc. |
| Opercab ® A40 | inorganic pigment particulates (PCC) | SMI |
| Disperal ® HP-14 | inorganic pigment particulates (Alumina) | Sasol Co. |
| Mowiol ® 6-98 | polyvinyl alcohol (PVA) binder | Kurraray |
| Mowiol ® 40-88 | polyvinyl alcohol (PVA) binder | Kurraray |
| Calcium Chloride | Fixer for ink pigment | Sigma-Aldrich Co |
| Roven ® 4040 | polyacrylic latex binder | Mallard Creek Polymers |
| Alcosperse ®149 | acrylate-based dispersant | AkzoNobel |
| Foamaster ®VF | defoamer | BASF |
| Dynwet ®800 | surfactant | BYK Inc. |

Example 1

Ink Layers Formulations

The formulation of the image receiving layer (IR layer) and of the curvature control layer (CC layer) are expressed in Table 2 and Table 3 below (Formulation Exp. 6, 7, 13 and 14 are comparative examples). The numbers represent the parts by dry weight of each component present in each layer. The WT value is the multiplication factor of dry weight percent of binders and coating thickness. The coating compositions are prepared in the laboratory by charging, first, an appropriate amount of water into the vessel followed by inorganic pigments and other polymeric binders and/or additives such as polyvinyl alcohol. Optionally, other coating additives such as pH control agent, water retention agent, thickener agent and surfactant can be added.

TABLE 2

| IR layer | Exp. 1 | Exp. 2 | Exp. 3 | Exp. 4 | Exp. 5 | Exp. 6 (comp.) | Exp. 7 (comp.) |
|---|---|---|---|---|---|---|---|
| Disperal ® HP-14 | 100 | 100 | 100 | 100 | 100 | 100 | 100 |
| Mowiol ® 6-98 | 3 | 3 | 3 | 3 | 3 | 3 | 3 |
| Mowiol ® 40-88 | 7 | 10 | 15 | 20 | 30 | 20 | 30 |
| $CaCl_2$ | 1 | 1 | 1 | 1 | 1 | 1 | 1 |
| Dynwet ®800 | 0.5 | 0.5 | 0.5 | 0.5 | 0.5 | 0.5 | 0.5 |
| Coating thickness (gsm) | 5 | 5 | 5 | 3 | 1.5 | 5 | 5 |
| WT value | 0.448 | 0.568 | 0.753 | 0.554 | 0.368 | 0.924 | 1.227 |

TABLE 3

| CC layer | Exp. 8 | Exp. 9 | Exp. 10 | Exp. 11 | Exp. 12 | Exp. 13 (comp.) | Exp. 14 (comp.) |
|---|---|---|---|---|---|---|---|
| Hydrocarb ® H60 | 20 | 20 | 20 | 20 | 20 | 20 | 20 |
| Opercab ® A40 | 80 | 80 | 80 | 80 | 80 | 80 | 80 |
| Mowiol ® 40-88 | 5 | 5 | 10 | 15 | — | 20 | 15 |
| Roven ®4040 | — | — | — | — | 10 | — | — |
| Dynwet ®800 | 0.5 | 0.5 | 0.5 | 0.5 | 0.5 | 0.5 | 0.5 |
| Foamaster ®VF | 0.2 | 0.2 | 0.2 | 0.5 | 0.5 | 0.2 | 0.2 |
| Alcosperse ®149 | 0.2 | 0.2 | 0.2 | | | 0.2 | 0.2 |
| Coating thickness (gsm) | 3 | 5 | 5 | 2 | 5 | 5 | 5 |
| WT value | 0.138 | 0.225 | 0.431 | 0.254 | 0.431 | 0.794 | 0.620 |

Example 2

Printable Recording Media

Series of paper base substrates are coated with image receiving layer and curvature control layer coating compositions as shown in Tables 2 and 3, in order to produce coated media Samples A to I as illustrated in Table 4. The paper base substrates, used for the media in this example, are made on a paper machine from a fiber furnish consisting of about 80% to 100% hardwood fibers, of about 0% to 20% softwood, and up to 25% precipitated calcium carbonate with alkyl ketene dimers (AKD) internal size. The basis weight of the substrate is of about 160 to 170 gsm. The paper substrates are coated with different image receiving layer and curvature control layer as detailed in the following Table 4. The coating process is accomplished either in small quantities by hand drawdown using a Mayer rod in a plate coating station, or in a large quantity by a pilot coater equipped with a flexible blade as the metering device. The printable recording media (samples A to I) are build using different image receiving layers and different curvature control layers. An identical image sequence is printed on the printable media samples 1 to 10.

The printable recording media samples A to J are tested for the$_{ir}$ curvature performances and image quality. The$_{ir}$ performances are illustrated in Table 4 below. The image quality is evaluated by measuring Gamut Measurement (Gamut), L*min, bleeding, and coalescence. Gamut Measurement (Gamut) represents the amount of color space covered by the ink on the media. Gamut volume is calculated using L*a*b* values of 8 colors (cyan, magenta, yellow, black, red, green, blue, white) measured with an X-RITE®939 Spectro-densitometer (X-Rite Corporation), using D65 illuminant and 2° observer angle. L*min value testing is carried out on a black printed area and is measured with an X-RITE®939 Spectro-densitometer, using D65 illuminant and 2° observer angle. This measure determines how "black" the black color is. A lower score indicates a better performance. Bleed testing is carried out with a bleed stinger pattern. 1016 micron lines (or 40 mil, where 1 mil=1/1000th of an inch) of cyan, magenta, yellow, black, red, green, blue inks, passing through solid area fills of each color, are printed and scanned. The bleed is evaluated visually for acceptability. The curvature performances is evaluated by measuring and then average the height of the four corners on 8.5"×11" (216 mm×279 mm) media sheets. The curvature and image quality sample performances are given a global rating score according to a 1 to 5 scale (wherein 1 means the worst performance and 5 represents the best performance).

The results of these tests are illustrated in Table 4. According to such results, it can be seen that printable recording media (sample G to J) having an ink receiving layers with a $(WT)_{IR}$ factor that is above 0.9 (such as examples 6 and 7) or having a curvature control layer with a $(WT)_{CC}$ factor above 0.6 (such as examples 13 and 14) show bad curvature performances regardless the nature of coating composition present on the opposite side (i.e. curvature control layer or ink receiving layers respectively). In addition, it can be seen that printable recording media (sample A to F) having an ink receiving layers with a $(WT)_{IR}$ factor that is below 0.9 and having a curvature control layer with a $(WT)_{CC}$ factor below 0.6 but not having R value between 1.6-3.0 show bad curvature correction, i.e. do not yield to a flat sheet. The media according to the present of the present disclosure provides thus the best overall scores on image quality and curvatures performances.

TABLE 4

| Media Sample | IR layer | $WT_{IR}$ value | CC layer | $WT_{CC}$ value | R value | Curvature | Image quality |
|---|---|---|---|---|---|---|---|
| Sample A | Exp. 3 | 0.753 | Exp. 10 | 0.431 | 1.75 | 5 | 5 |
| Sample B | Exp. 3 | 0.753 | Exp. 11 | 0.254 | 2.96 | 3 | 5 |
| Sample C | Exp. 3 | 0.753 | Exp. 9 | 0.225 | 3.35 | 1 | 2 |
| Sample D | Exp. 5 | 0.368 | Exp. 10 | 0.431 | 0.85 | 2 | 3 |
| Sample E | Exp. 5 | 0.368 | Exp. 11 | 0.254 | 1.45 | 2 | 3 |
| Sample F | Exp. 5 | 0.368 | Exp. 9 | 0.225 | 1.64 | 3 | 4 |
| Sample G (comp.) | Exp. 3 | 0.753 | Exp. 13 | 0.794 | 0.95 | 1 | — |
| Sample H (comp.) | Exp. 3 | 0.753 | Exp. 14 | 0.620 | 1.2 | 1 | — |
| Sample I (comp.) | Exp. 6 | 0.924 | Exp. 10 | 0.431 | 2.14 | 1 | — |
| Sample J (comp.) | Exp. 7 | 1.227 | Exp. 10 | 0.431 | 2.85 | 1 | — |

The invention claimed is:

1. A printable recording media comprising:

a. a substrate, b. an ink receiving layer, on the image side of the substrate, having a $(WT)_{IR}$ factor of less than 0.9;

c. and a curvature control layer, on the backside of the substrate, having a the $(WT)_{cc}$ of less than 0.6;

wherein the R value, $(WT)_{IR}/(WT)_{cc}$, is ranging from 1.6 to 3.0; and wherein the ink receiving layer and the curvature control layer include, at least, a single or multiple types of polymeric binders and, at least, a single or multiple types of inorganic pigment particles.

2. The printable recording media according to claim 1 wherein the ink receiving layer comprises an electrical charged substance; a single or multiple types of polymeric binders and at least a single or multiple types of inorganic pigment particles.

3. The printable recording media according to claim 2 wherein the electrical charged substance is a water soluble divalent or multi-valent metallic salt.

4. The printable recording media according to claim 1 wherein the polymeric binders that are present in the ink receiving layer and in the curvature control layer are water soluble polymeric binders.

5. The printable recording media according to claim 1 wherein the ink receiving layer has a construction which comprises multi-layer structures which are based on the same or different coating composition, each comprising an electrical charged substance; a single or multiple types of polymeric binders and at least a single or multiple types of inorganic pigment particles.

6. The printable recording media according to claim 1 wherein the inorganic pigment particles, that are present in the ink receiving layer, have an average particle size in the range of about 1 to about 150 nanometers.

7. The printable recording media according to claim 1 wherein the inorganic pigment particles, that are present in the ink receiving layer, are metal oxides or complex metal oxides particles.

8. The printable recording media according to claim 1 wherein the inorganic pigment particles, that are present in the curvature control layer, are calcium carbonate pigment particles.

9. The printable recording media according to claim 1 wherein the ink receiving layer and the curvature control layer contain from about 40 wt % to about 95 wt % of inorganic pigment particles by total weight of each layer.

10. The printable recording media according to claim 1 wherein the ink receiving layer that is applied on the image side of the supporting base substrate forms a layer having a coat-weight in the range of about 0.5 to about 30 gsm.

11. The printable recording media according to claim 1 wherein the curvature control layer that is applied on the on the backside of the substrate forms a layer having a coat-weight in the range of about 0.5 to about 30 gsm.

12. The printable recording media according to claim 1 wherein the substrate is a paper base substrate.

13. The printable recording media according to claim 1 wherein a resin-rich layer is present between the substrate and the ink receiving layer.

14. An article comprising:

a cellulose paper substrate having, on its image side, a resin-rich layer and an ink receiving layer that comprises an electrical charged substance;

a single or multiple types of polymeric binders and at least a single or multiple types of inorganic pigment particles; and a curvature control layer that comprises a single or multiple types of polymeric binders and at least a single or multiple types of inorganic pigment particles, wherein the ink receiving layer has a $(WT)_{IR}$ factor of less than 0.9 and the curvature control layer has a the $(WT)_{CC}$ of less than 0.6; and wherein the R value, $(WT)_{IR}/(WT)_{CC}$, is ranging from 1.6 to 3.0.

15. A method for making a printable recording media comprising:

a. providing a substrate;

b. applying a ink receiving layer having a $(WT)_{IR}$ factor of less than 0.9 on the image side of the substrate;

c. applying a curvature control layer having a the $(WT)_{CC}$ of less than 0.6 on the backside of the substrate;

d. drying said layers in order to obtain a printable recording media wherein the R value, $(WT)_{IR}/(WT)_{CC}$, is ranging from 1.6 to 3.0; and wherein the ink receiving layer and the curvature control layer include, at least, a single or multiple types of polymeric binders and, at least, a single or multiple types of inorganic pigment particles.

* * * * *